US005950912A

United States Patent [19]

Economopoulos

[11] Patent Number: 5,950,912

[45] Date of Patent: Sep. 14, 1999

[54] DUAL PIZZA PIE BOX

[76] Inventor: Demosthenes O. Economopoulos, Minoas 95, Megara Attikis, Greece, 19100

[21] Appl. No.: 09/079,341

[22] Filed: May 14, 1998

[51] Int. Cl.[6] ..... B65D 5/49

[52] U.S. Cl. ..... 229/120.32; 229/152; 229/160.2; 229/906

[58] Field of Search ..... 229/120.32, 152, 229/154, 160.2, 190, 191, 902, 906

[56] References Cited

U.S. PATENT DOCUMENTS

| | | | |
|---|---|---|---|
| D. 362,803 | 10/1995 | McMullen, Jr. | D9/432 |
| 2,732,121 | 1/1956 | McGovern . | |
| 2,758,774 | 8/1956 | Grunert et al. | 229/120.32 |
| 2,926,831 | 3/1960 | Strange . | |
| 3,013,710 | 12/1961 | Kronson et al. | 229/190 |
| 4,356,953 | 11/1982 | Rekow . | |
| 4,739,921 | 4/1988 | Taub | 229/120.32 |
| 5,002,221 | 3/1991 | Ragan | 229/120 |
| 5,351,880 | 10/1994 | Goudreau | 229/120.32 |
| 5,544,806 | 8/1996 | Anderson et al. | 229/178 |

*Primary Examiner*—Gary E. Elkins
*Attorney, Agent, or Firm*—Young & Basile, P.C.

[57] ABSTRACT

A rectangular box for transporting two pizza pies in a stacked formation formed by a single cardboard blank having scoring and cut-outs for assembling into a dual pizza box. The box has a bottom wall, four side walls and a lid hinged to one of the side walls. When assembled the box has corner shelf supports for positioning a second pizza pie. The shelf supports also provide a stop for the lid of the box to prevent crushing the contents.

7 Claims, 3 Drawing Sheets

DUAL PIZZA PIE BOX

FIELD OF THE INVENTION

The present invention relates to an improved two-layered pizza box.

BACKGROUND OF THE INVENTION

It is common for customers to order carry-out pizza pies or to order delivery of the pizza pies. Many times the customers will order two pizza pies having different toppings to accommodate the different tastes of their guests or family. To transport the pizza pies, it is more convenient to have the two pizza pies packaged within one pizza pie box. It is also more efficient for the pizza shop owner to provide a single foldable cardboard structure that folds into a dual pizza pie box. The use of a dual pizza pie box saves on storage space and cost.

Dual pizza pie boxes are known in the art. U.S. Pat. No. 5,002,221 issued to Ragan discloses one type of stacked pizza pie box. This prior art discloses a dual pizza pie box formed by a single perforated end cut flat cardboard structure. When folded, poke-in internal shelf supports are positioned at each corner of the box to support a second pizza pie on a shelf resting on the poke-in shelf supports. The prior art further discloses a separator stand for holding the shelf and the lid away from the enclosed pizza pies.

The present invention provides an improvement over the prior art. The separator stand disclosed in the prior art requires additional storage space at the pizza shop plus added cost of the pizza pie box. Therefore, it is desirable to construct a dual layer pizza pie box that does not require the separator stand, but also prevents the lid from crushing the top ingredients of the pizza pie.

SUMMARY OF THE INVENTION

The present invention provides a storable single cardboard sheet that is perforated and cut to provide a foldable pizza pie box having dual layers. The invention further provides a dual pizza pie box having a lid with flaps that correspond to shelf supports within the box that prevent the lid from crushing the upper pizza pie. The lid further includes tabs that extend over the vertical edges of the box to prevent the lid from being crushed inwardly. The pizza pie box of the present invention also provides structural means to provide strength and durability to the pizza pie box.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
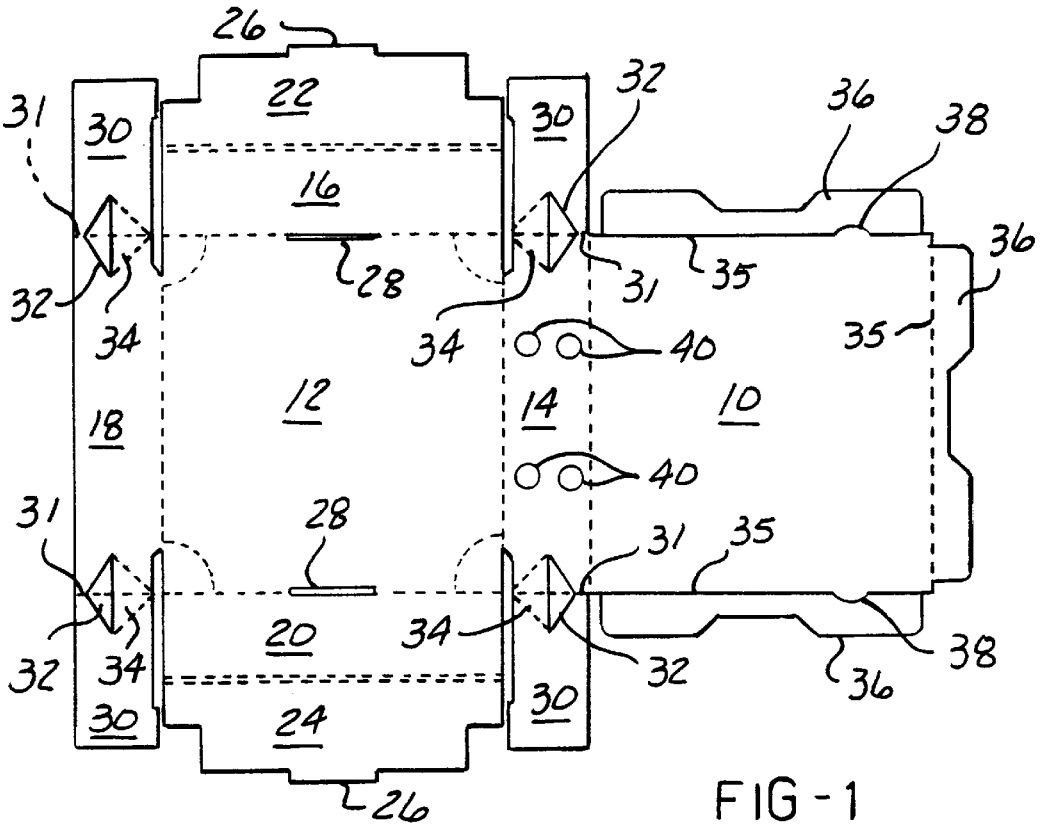
FIG. 1 shows an unfolded cardboard box scored and having cut-outs used to form the box of the present invention.
Figure 2:
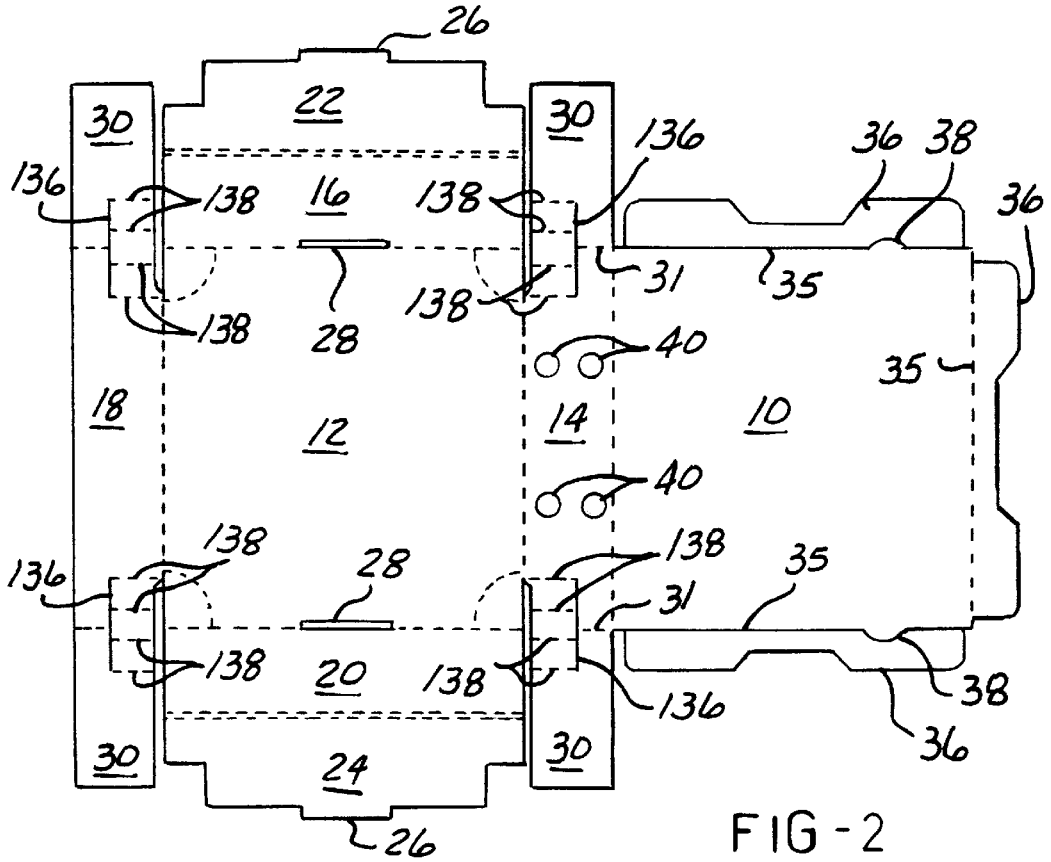
FIG. 2 shows another alternative embodiment of the unfolded cardboard type box scores and having cut-outs used to form another box of the present invention.
Figure 5:
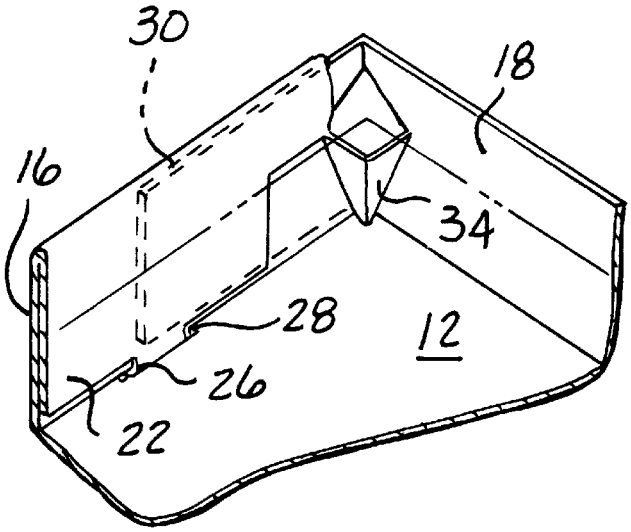
FIG. 5 is a sectional view of an inside corner of the box of FIG. 1 assembled.

FIGS. 1 and 2 show a cardboard type boxed in their unassembled configuration to illustrate the features and differences between the two embodiments. Each unassembled box includes a lid 10 and a bottom floor 12. The lid 10 is hinged to the bottom floor 12 of the box and separated by a vertical side wall 14. The remaining three vertical side walls are designated as 16, 18 and 20 respectively. Side walls 16 and 20 are reinforced by having a hinged flap 22 and 24 respectively for doubling the side wall strength of the pizza box. Each opposing side wall 16 and 20 has a tab 26 that is insertable into slot 28 at the base of each opposing side wall 16 and 20. This forms a locking means to secure flaps 22 and 24 to side walls 16 and 20 respectively. When flaps 22 and 24 are folded over side walls 16 and 20 respectively, an envelope is formed between the two layers. Side walls 14 and 18 remain single layered, but have extending flaps 30 extending from each end. Extending flaps 30 are foldable within the envelopes formed by flap 22 and wall 16 and flap 24 and wall 20 respectively. This arrangement is shown more clearly in FIG. 5.

In the first embodiment, at each corner fold line 31 separating the side walls 14 and 18 with their respective extending flaps 30, there is located foldable support members formed by triangular cut-outs 32 and triangular fold-outs 34. The triangular fold-outs 34 extend to approximately half the height of the side walls 14, 16, 18, 20. Therefore, when the box is assembled as better shown in FIG. 5, the corner supports 34 provide the support half way the height of the box for a second pizza pie.

Figure 3:
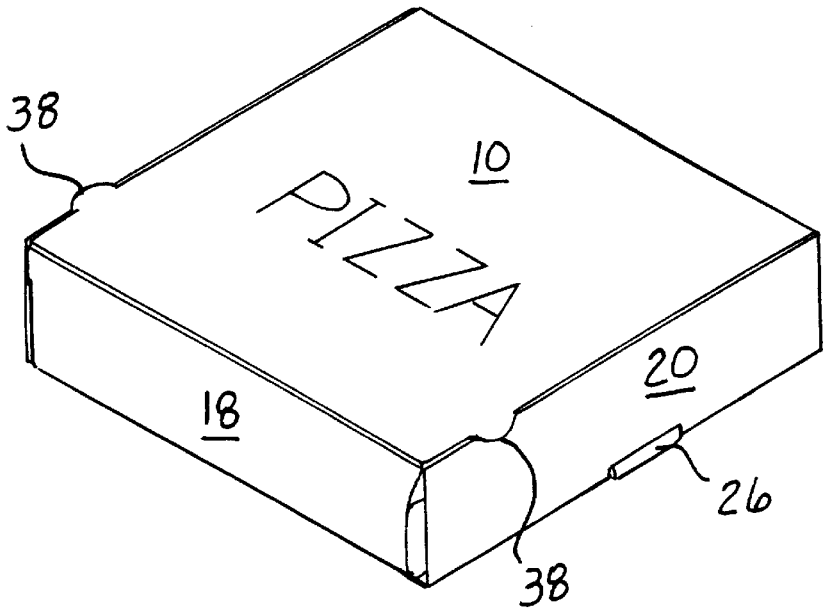
FIG. 3 is a perspective view of the box of FIGS. 1 and 2 assembled and showing a lid in the closed position.
Figure 4:
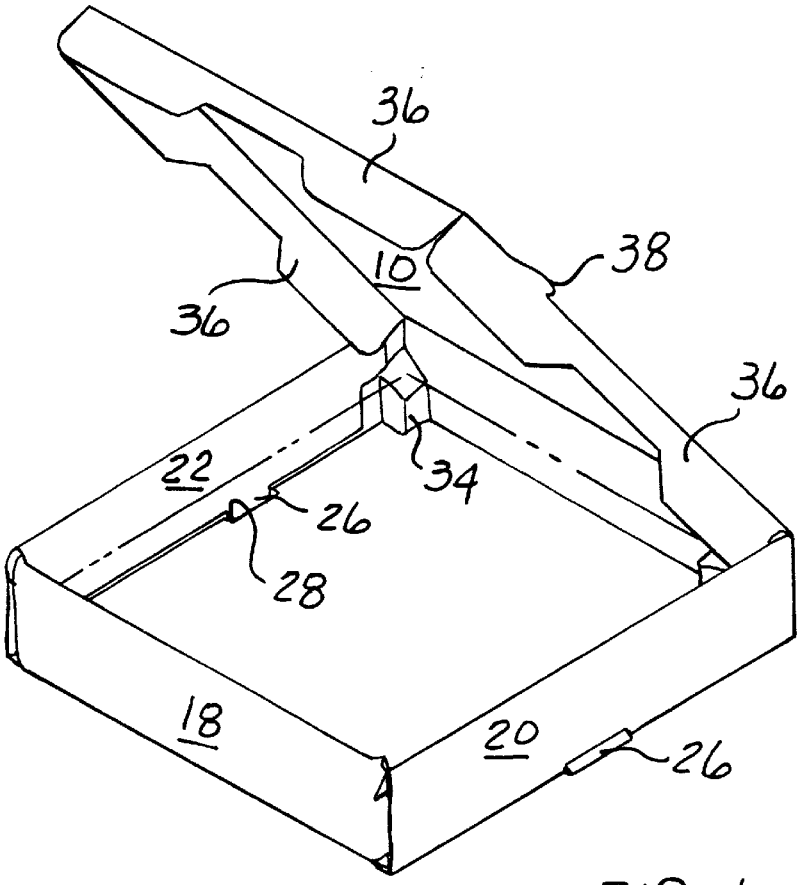
FIG. 4 is a perspective view of the box of FIG. 1 assembled and showing the lid in the open position.

The lid 10 when folded along the perforated edges 35 includes three downwardly extending flaps 36. The downwardly extending flaps 36 of the lid are configured and sized such that when the lid 10 is in its closed position, as is shown in FIG. 3, a portion of the extending flaps 36 meet the fold-out corners 34, which stop the further lowering of the lid 10. Therefore, the fold-out corners 34 serve a dual purpose of acting as a support for a second layer pizza pie as well as a stop in conjunction with the downwardly extending flaps 36 of the lid 10 to prevent the lid 10 from crushing the pizza pie.

In addition, when the lid 10 is folded for use, the lid 10 also includes a small cut-out tab 38 that extends horizontally outwardly from opposing sides of the lid 10. When the lid 10 is folded such that the downwardly extending flaps 36 are extending into the interior of the pizza box, the extending tabs 38 extend over the opposed side walls 16 and 20 to provide another stop means for the lid 10. The small tabs 38 further act as a grip for lifting the lid 10 away from the side walls 16, 18, 20 such that the interior of the pizza box is exposed. Other features of this dual stacked pizza pie box includes vent holes 40 on at least one of the side walls and situated to vent both levels of pizza pies.

Figure 6:
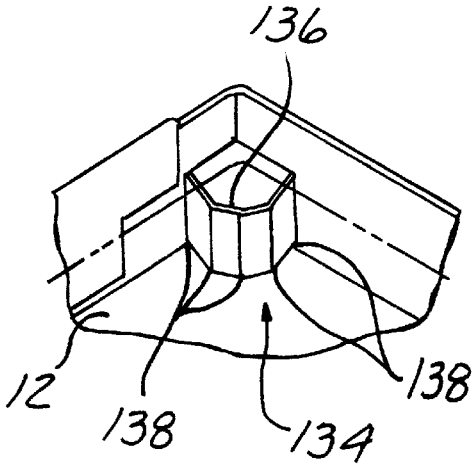
FIG. 6 is a sectional view of an inside corner of the box of FIG. 2 assembled.
Figure 7:
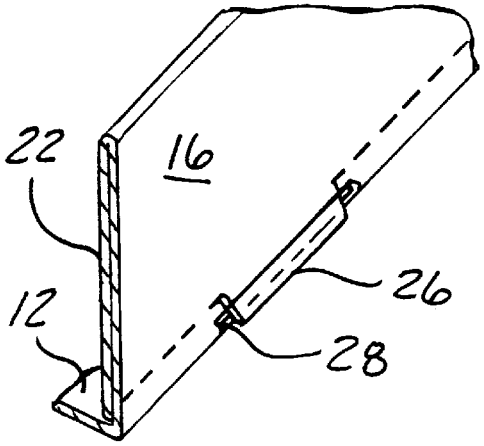
FIG. 7 is a section view of an inside flap as assembled.

The second embodiment as shown in FIGS. 2 and 6 is similar to the first embodiment except for the fold-out shelf support as designated by 134 in FIG. 6. The support shelf 134 is located in each corner, and is formed by a single slit 136 and multiple fold lines 138 such that when folded, a rounded corner support 134 is formed. The rounded corner support of FIG. 6 is also positioned at a height to correspond with flap 36 to form a stop for the lid 10.

Although not shown, a single layer cardboard shelf may be placed on the fold-out shelf supports 34 and 134 before placing the second pizza pie on the shelf supports 34 and 134.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An improved cardboard pizza box for transporting more than one pizza pie, said box having a rectangular floor, four side walls integrally connected to the floor and forming four corners, and a lid integrally connected to one of the side walls spaced from the floor, the improvement comprising:

said lid having foldable flaps for extending along portions of the side walls when said lid is in the closed position;

integral shelf supports positioned adjacent the rectangular floor and formed by perforated and cut portions at the corners for folding inwardly, wherein the shelf supports have a height configured to provide a stop for the foldable flaps of the lid when said lid is in the closed position.

2. The improved cardboard pizza box of claim 1, wherein said lid further includes extending portions that extend over the side walls when the lid is in a closed position.

3. The improved cardboard pizza box of claim 1, wherein the perforated and cut portions form a triangular support.

4. The improved cardboard pizza box of claim 1, wherein the perforated and cut portions form a support having more than two sides.

5. The improved cardboard pizza box of claim 1, wherein two of the opposed side walls have extensions for folding over to form dual layer walls.

6. The improved cardboard pizza box of claim 5, wherein the other two adjacent side walls have extending flaps for folding between the adjacent dual layer walls.

7. The improved cardboard box of claim 5, wherein each extension has a tab and each respective side wall has a slot for receiving said respective tab when the extensions are folded to form dual layer walls.

* * * * *